United States Patent [19]

Bobkowicz

[11] 4,359,856

[45] Nov. 23, 1982

[54] PROCESS FOR FORMING A YARN USING A PARTIALLY ORIENTED CARRIER FILAMENT

[76] Inventor: Emilian Bobkowicz, 1435 St-Alexander St., Montreal, Quebec, Canada

[21] Appl. No.: 81,639

[22] Filed: Oct. 4, 1979

[51] Int. Cl.[3] ..... D02G 3/36

[52] U.S. Cl. ..... 57/5; 57/6; 57/310

[58] Field of Search ..... 57/3, 5, 6, 11, 12, 57/13, 210, 224, 225, 226, 227, 310

[56] References Cited

U.S. PATENT DOCUMENTS

| | | | |
|---|---|---|---|
| 3,439,491 | 4/1969 | Scruggs | 57/5 |
| 3,835,638 | 9/1974 | Mayer et al. | 57/5 X |
| 3,845,611 | 11/1974 | Senturk et al. | 57/5 |
| 4,028,871 | 6/1977 | Ashenbrenner | 57/5 X |
| 4,083,173 | 4/1978 | Artzt et al. | 57/5 X |
| 4,209,965 | 7/1980 | Bobkowicz | 57/5 |
| 4,244,174 | 1/1981 | Bobkowicz | 57/224 X |

*Primary Examiner*—Donald Watkins
*Attorney, Agent, or Firm*—Robert J. Schaap; Eric Fincham

[57] ABSTRACT

The invention provides a process and apparatus for forming a yarn of at least two separate continuous filaments and a plurality of fibers. At least one of the filaments is of a partially oriented thermoplastic material such that when a twisting force is applied, a retained twist is obtained due to inter-molecular slippage in the partially oriented filament.

7 Claims, 9 Drawing Figures

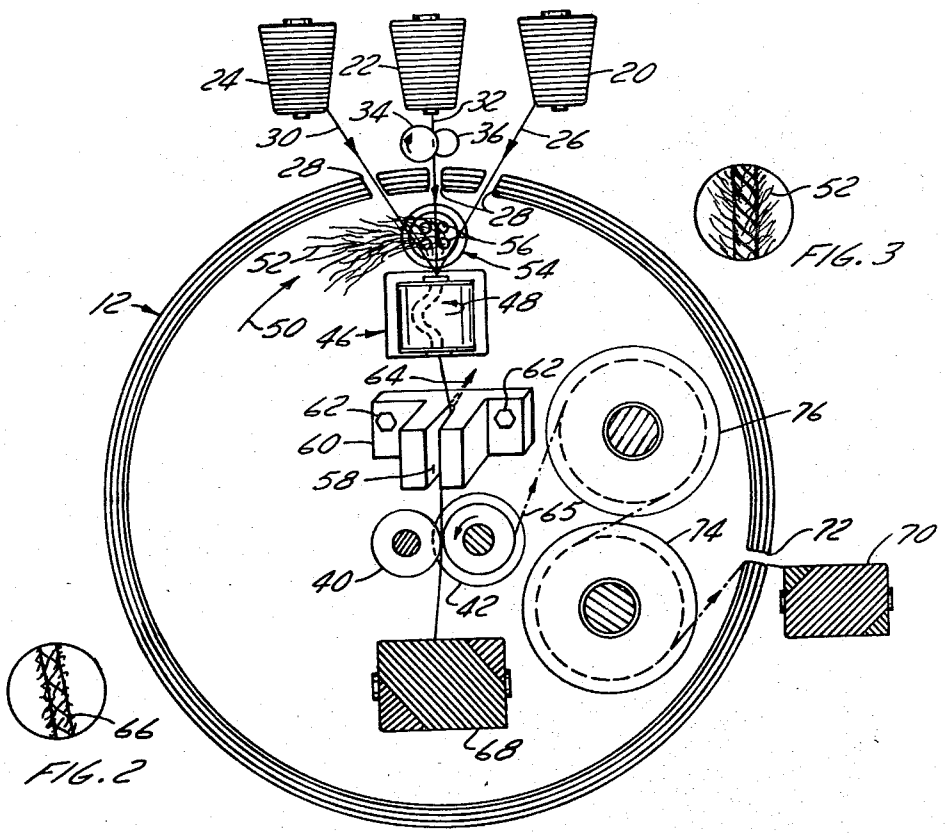
FIG. 1
FIG. 2
FIG. 3
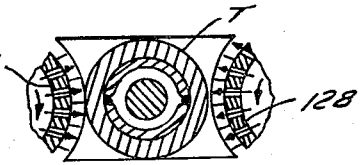
FIG. 5
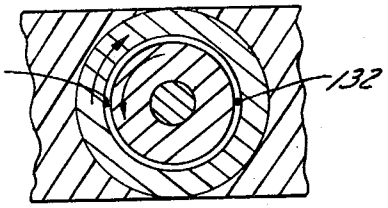
FIG. 6
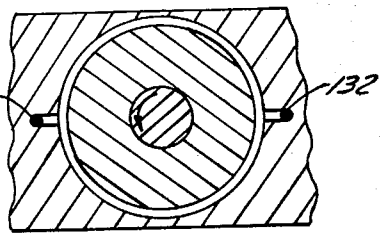
FIG. 7

PROCESS FOR FORMING A YARN USING A PARTIALLY ORIENTED CARRIER FILAMENT

This invention relates to a process, apparatus and new products produced by the process, which are formed of two or more filaments, combined with short fibers to form a plied-type yarn.

There are, at present, certain known processes for forming filaments into yarns using short fibers. In one of these process, the use of a thermoplastic core or carrier is employed in which the short fibers are adhered to the thermoplastic core by placing the short fibers into juxtaposition with the core material when it is in a molten and/or tacky condition.

The present process eliminates the need for a thermoplastic core or carrier which has to be in a molten condition but at the same time, retains the advantageous features of utilizing short fibers in combination with two or more filaments of natural or synthetic material, at least one of which is a partially oriented structure.

In accordance with the process of the present invention, there is provided a procedure for forming plied-type yarns by the steps of providing a least two separate continuous filamentary materials, at least one of which is a thermoplastic partially oriented material, providing a source of discrete short fibers, advancing said filaments in a given direction between two pinch points, subjecting said filaments, between said pinch points, to a twisting step, and feeding into juxtaposition with said filaments at a point between the first pinch point in the direction of advancement of the filamentary materials, and the twisting step, a plurality of said short fibers to form said plied-type yarn.

In greater detail of the process of the present invention, the filamentary materials which are used to form the plied-type yarn may be any suitable type of filamentary material having the desired properties and characteristics which are required in the final plied-type yarn product, with the proviso that at least one of the filamentary materials is a partially oriented material. Partially oriented materials are well known in the art and such materials include, for example, polyesters, polyolefins of various types, etc. All of the filamentary materials utilized in the process of the present invention can be partially oriented; however, it has been found that only one filamentary material need be employed which is partially oriented. In the case of utilizing two or more partially oriented filaments, the properties of the resulting product can be varied according to the type of partially oriented material and the number of filaments which have this characteristic. The other filamentary materials which are of a non-oriented nature may be any suitable filamentary material commonly employed in the textile art and typical of such materials include those synthetic and natural materials such as those materials derived from polyolefins, polyamides, polyesters, etc.

The short fibers used in the process of the present invention may be any suitable type, again the properties desired in the end product will dictate the type of fibers employed. These fibers may also be of natural or synthetic nature. The term "short fibers" has a known meaning in the textile art and as such, those known type of fibers can be employed in the process of the present invention. In the case of both the filamentary materials and the short fibers, the denier may vary considerably again depending on the properties desired in the final product.

In the process of the present invention, various embodiments may be employed in which the filamentary materials are preferably fed to a point of joinder at an angle greater than 0° but less than 90°. At the point of joinder of the filamentary materials or just prior to or subsequent to such a point, the short fibers may be introduced into the process to combine with the filamentary materials which are placed in juxtaposition.

Following formation of the plied-type yarn, the yarn itself may be subjected to various conventional expedients such as passing the yarn over a heated roller, etc. in order to alter or modify the properties of yarn—e.g., to "set" the yarn and to create a greater softness for the yarn.

In accordance with a further aspect of the present invention, there is provided an apparatus suitable for carrying out the above-described process; the apparatus comprises supply means for supplying at least two separate continuous filaments, at least one of which is composed of a thermoplastic partially oriented material, means for creating a pair of spaced apart pinch points, and means for introducing a plurality of short fibers into juxtaposition with said filaments between the point at which the twister is located and the first of said pinch points.

In the apparatus of the present invention, any suitable twister may be employed such as those well known in this art for that purpose. The apparatus, in one embodiment, may comprise more than one apparatus system for producing a plied-type yarn in a machine—i.e., the machine may be a dual-headed or a multi-headed machine capable of producing several plied yarns from the same machine. In this case, the twister may be of a type which can twist two or more yarns simultaneously.

The supply means for supplying at least two separate continuous filaments may be any suitable source such as a length of filamentary material wound into a roll or bobbin of the same. The material is merely drawn from the roll as required by the apparatus and the process. The means for creating a pair of spaced apart pinch points may likewise be any suitable device for accomplishing this; in a very simple embodiment, a pair of spaced apart rollers achieve this to define the fixed point at each spaced apart location; preferably one or both rollers may be rotatably driven in time-related sequence to the requirements of the process and the apparatus.

The means for introducing a plurality of short fibers into juxtaposition with the filaments may comprise any suitable means for providing such a supply of short fibers, whether utilizing such short fibers as the initial starting material or alternatively, and more economically, utilizing a sliver from which the short fibers are doffed and combed, and projected into juxtaposition with the filaments. Lickerin structures per se are well known and any suitable lickerin structure accomplishing this purpose may be employed.

It has been known, up until now, for the manufacture of staple fiber spun yarns, that it was generally considered impossible to retain a twist imparted between two fixed points since the twist imparted above the twisting unit is removed by the opposite twist formed below the twisting point. Thus, it was necessary in ring spinning to revolve the whole yarn package collecting the yarn in the same direction of the twist to retain the twist and which prevents linear spun yarn production.

With the process of this invention the central mono- or multi-filament used is in the form of a partially oriented filament which prevents the buildup of a counter torque due to inter-molecular slippage to enable the buildup and retention of an adequate positive twist in the yarn strand just before the linear wind up of the twist containing yarn into any preferred size of yarn package. In addition, the short fiber ends are entrapped between the filaments and specifically, in the case of three filaments, between the two outer filaments and are pulled off any yarn package with an adequate slippage tension with the result that loose staple fiber ends, passing through a stationary V-shaped groove, which is preferably provided with suction slots, are forced to helically wrap around the fiber ends and around the inner core of the filamentary package, to form a double (opposite to each other) twist configuration resulting in a novel plied yarn structure. Such linear spun yarn production will be possible at speeds of about 2000 to 3000 feet per minute with linear wind up of the yarn into any preferred size, cheese-cake like, yarn package.

Having thus generally described the invention, reference will now be made to the accompanying drawings, illustrating preferred embodiments, and in which:

FIG. 1 is a schematic view of an apparatus for carrying out one embodiment of the present invention;

FIG. 2 is an enlarged view of the yarn as it emerges from the twister in FIG. 1;

FIG. 3 is a view of the yarn following consolidation;

FIG. 5 is a section taken along the line 5—5 of FIG. 4;

FIG. 6 is a section taken along the line 6—6 of FIG. 4;

FIG. 7 is a section taken along the line 7—7 of FIG. 4;

Figure 4:
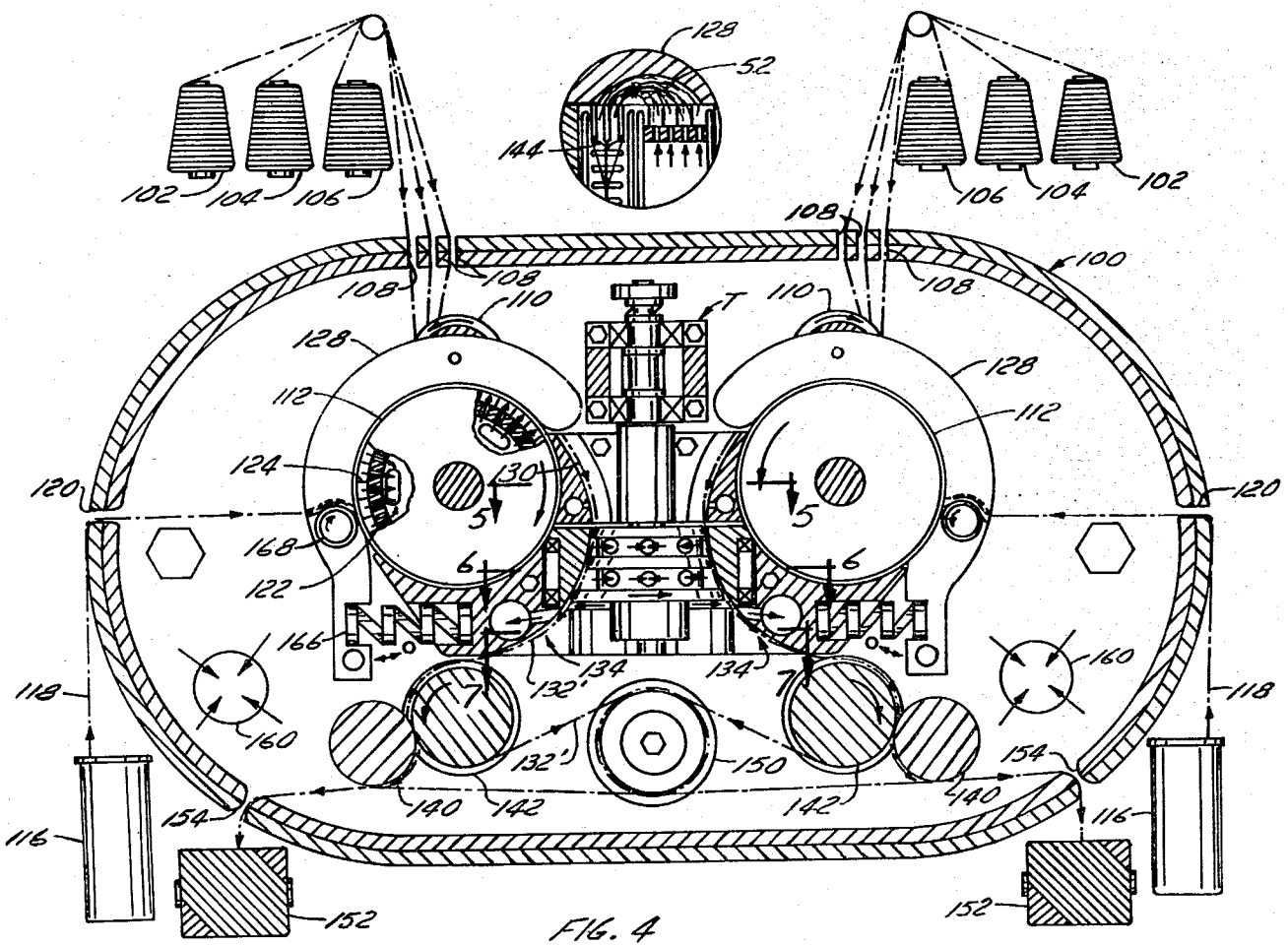
FIG. 4 is a schematic view of a further apparatus according to the present invention for carrying out the process, showing several of the components in cross-section for greater clarity.

Referring initially to FIG. 1, there is illustrated a typical apparatus in section which may be used to carry out the process and produce the products of the present invention. To this end, the apparatus is normally included within a housing indicated generally by reference numeral 12 which may be provided with a cover (not shown) for containing the total apparatus within a dust-proof arrangement. In the embodiment illustrated, a source of three filamentary materials is provided indicated generally by reference numerals 20, 22 and 24 in the form of spools of continuous filament material. At least one of the filamentary materials 20, 22 or 24 is of a partially oriented nature—in the arrangement shown, the supply 22 may comprise for example, partially oriented polyester filaments. Three apertures are provided in the housing 12, indicated by reference numeral 28, for passing the length of filamentary material 26, 30 and 32 into the apparatus. In the case of the partially oriented filamentary material 32, a pair of cooperating rollers 34 and 36 are provided which form a pinch point through which the filamentary material 32 passes. These rollers thus constitute a pinch point or provide a fixed point for the filament 32.

A second fixed point is provided by cooperating rollers 40 and 42, both rotating about a fixed axis as do rollers 34 and 36. At least one of the rollers 40 and 42 are driven, in this case roller 42, as is the case with roller 34 which is likewise driven in a positive manner.

The rollers 40 and 42 thus provide a second pinch point or in other words, a fixed point, between which the yarn and filamentary materials pass.

Interposed between the two fixed points is a twister 46, which may be any suitable twister. In the version illustrated in FIG. 1, the twister is a friction twister rotating in the direction of the arrow 48.

The filaments 26, 28 and 30 are joined on entry to the twister 46 as will be seen from FIG. 1; at the point where they are joined or converge at the inlet of the twister 46, a supply of short staple fibers is provided by any suitable means (not shown) which may be typically of the type illustrated subsequently in FIGS. 4, 8 and 9. The supply of short staple fibers, being directed to the point of joinder of the filaments 26, 30 and 32 (as indicated by arrow 50, and which short fibers are generally indicated by reference numeral 52), is aided in being positioned relative to the point of joinder of the individual filaments, by means of a suction device indicated generally by reference numeral 54. To this end, suction device 54 may comprise simply a vacuum chamber within a housing with a plurality of small apertures 56 therein. In this manner, the short fibers are placed into juxtaposition with the filaments and in particular, the filament 32.

As will be seen from FIG. 1, in a preferred embodiment of the present invention, the filaments 30, 32 and 26 are fed into the twister at an angle relative to each other; preferably this angle is between 0° to 90°.

After passing through the twister 46, and as illustrated in FIG. 3, a yarn of the configuration illustrated in FIG. 3 is obtained. As will be noted in FIG. 3, the filaments are essentially twisted in one direction with the short fibers intermingled and associated with the filaments and projecting from the surface of the filaments.

After passing through the twister 46, the resulting product is then passed through a curved slot 58 of an extruded body 60 having the desired shape; the body 60 is bolted by means of bolt 62 to the overall apparatus. A source of vacuum (not shown) is preferably provided to create an air suction interiorly of the slot, as indicated by arrow 64. The resulting product, a plied-type yarn, is illustrated in FIG. 2 which, as will be noted, also includes a reverse twist with the short fibers 52 being now effectively secured between the filaments forming the yarn which at that point is designated by reference numeral 66. Thus, the short fibers as will be seen from FIG. 2 compared to FIG. 3, are intrinsically bound by the individual filaments and a stable resulting yarn is thus obtained. This yarn, after passing between the fixed point defined by rollers 40 and 42, may then be wound up by conventional means to form a roll 68 of the same.

With respect to the above-described apparatus, and the process which is carried out by the apparatus, and by way of further explanation, the use of a partially oriented filament 32 in the process with conventional filamentary materials 26 and 30 (although more than one of the latter filaments may also be of a partially oriented nature), there is a preferential twisting below the twister relative to the amount of twisting that occurs above the twister and due to the nature of the partially oriented filaments—i.e., the characteristics of the partially oriented filament—provides and permits internal slippage above the twister so that the amount of twisting below the twister is far greater. In this manner, the twisting is predominantly of a given direction (corresponding to the direction of twisting of the twister 46) as illustrated in FIG. 3 at the point immediately following the exit of the yarn from the twister but between the fixed point or pinch point achieved by rollers 40 and 42, a reverse twisting sets in, whereby the yarn formation illustrated in FIG. 2 is obtained for the final formation of the yarn.

FIG. 1 also illustrates a few alternative embodiments that may be employed with the present invention; specifically, in place of providing a straight wind-up system as illustrated in FIG. 1, the plied type yarn designated by dotted lines 65 may be passed around a pair of heated rolls 76 and 74 exiting through an aperture 72 after heat treatment and being wound up into a plied yarn roll 70. The gentle heat treatment applied by heated rolls 74 and 76 will impart additional desirable characteristics to the yarn, depending on the desired characteristics in the final yarn product.

Referring to FIG. 4, there is illustrated a still further embodiment of the present invention which essentially is a "double-headed" or "double-ended" machine, each side being substantially symmetrical. Again, a general housing for the machine, indicated by reference numeral 100, is provided which may be enclosed within a cover (not shown). Again, three filamentary supplies are illustrated although this may vary as desired, at least two being employed and as many as six or more may be employed if desired—in all cases, at least one of the filaments being of a partially oriented nature. The three supplies are indicated by reference numerals 102, 104 and 106 and any one of these may be employed as the source of partially oriented filament material. Each of the filaments are passed through aperture 108 into the interior of the housing 100, where they are placed into juxtaposition with each other about a driven rotating roll 110. The rotating roller 110 cooperates with a further counter rotating roller 112 to define a first pinch point to which the juxtaposed filaments are subjected; both the rollers 110 and 112 are mounted on appropriate shafts and driven by suitable means. To provide a source of short fibers, a web of sliver material is fed from a cannister 116, the sliver material being indicated by reference numeral 118. The sliver enters through aperture 120 in the wall of the apparatus and is fed to a lickerin device indicated generally by reference numeral 122 which is provided with projecting needles 124 or the like to provide a source of short fibers. These fibers, fed by the velocity of the rotating lickerin, are contained by means of a housing or cover 128 and placed into juxtaposition with the filaments in much the same manner as described with respect to FIG. 1. Thereafter, the resulting combined filamentary material and short fibers, indicated by reference numeral 130, are subsequently passed through a twister indicated generally by reference letter T. The construction of the twister T and the lickerin are both well known in the art and hence, detailed constructional features will be understood by those skilled in the art.

As will be seen from FIGS. 5 through 7, the consolidated filaments passing through the twister, and which are identified by reference numeral 132, are subjected to the action of the twister through a counter rotating force; whereafter the consolidated plied-type yarn 132' is passed through a conical slot indicated generally by reference numeral 134 and subsequently through a pair of rollers 140 and 142, rotating in the direction indicated by the arrows, and which constitute a second fixed or pinch point for the yarn. Thus, the same results as described with respect to FIG. 1 are obtained.

FIG. 4 illustrates at the upper portion thereof a partial exploded view of a portion of the lickerin assembly with the rotating roll or drum 112. As will be seen, the short fibers 52 doffed from the lickerin are directed into a recess 144 in the drum 112 to be intermixed and placed in juxtaposition with the filaments including the partially oriented filament. Due to the pair of spaced apart pinch or fixed points, the short fibers 52 are intermingled and partially inclined by the filaments during the twisting step whereby the same configuration is obtained as illustrated in FIGS. 2 and 3 at the respective points in this version of the apparatus compared to the equivalent points in the apparatus of FIG. 1.

There are additional embodiments illustrated in FIG. 4 in which, following passage of the plied-type yarn 132' from the rollers 140 and 142, the latter may be wound up on a suitable wind-up apparatus (not shown) to form a roll of plied-type yarn 152, after passing through an aperture 154 of the apparatus. As in FIG. 1, an alternative provides for the yarn 132' to pass over a heated roll 150 to "set" the yarn to impart additional properties to the product—which, depending on the type of filaments employed, may make the yarn softer. Also, to entrap any dust generated within the apparatus, a pair of spaced apart ports 160 may be employed to prevent dust escaping to the atmosphere from the apparatus.

It will be appreciated from the structure of the twister illustrated in the drawings that the twister illustrated functions as a dual or double twister to handle both ends of the apparatus.

In the apparatus, the housing cover 128 may be spring loaded by means of spring 166 journalled into one end of the cover 128 and at the other end, into a suitable frame member of the apparatus. A pivot point 168 is provided by which the cover may then be adjusted as desired.

Figure 8:
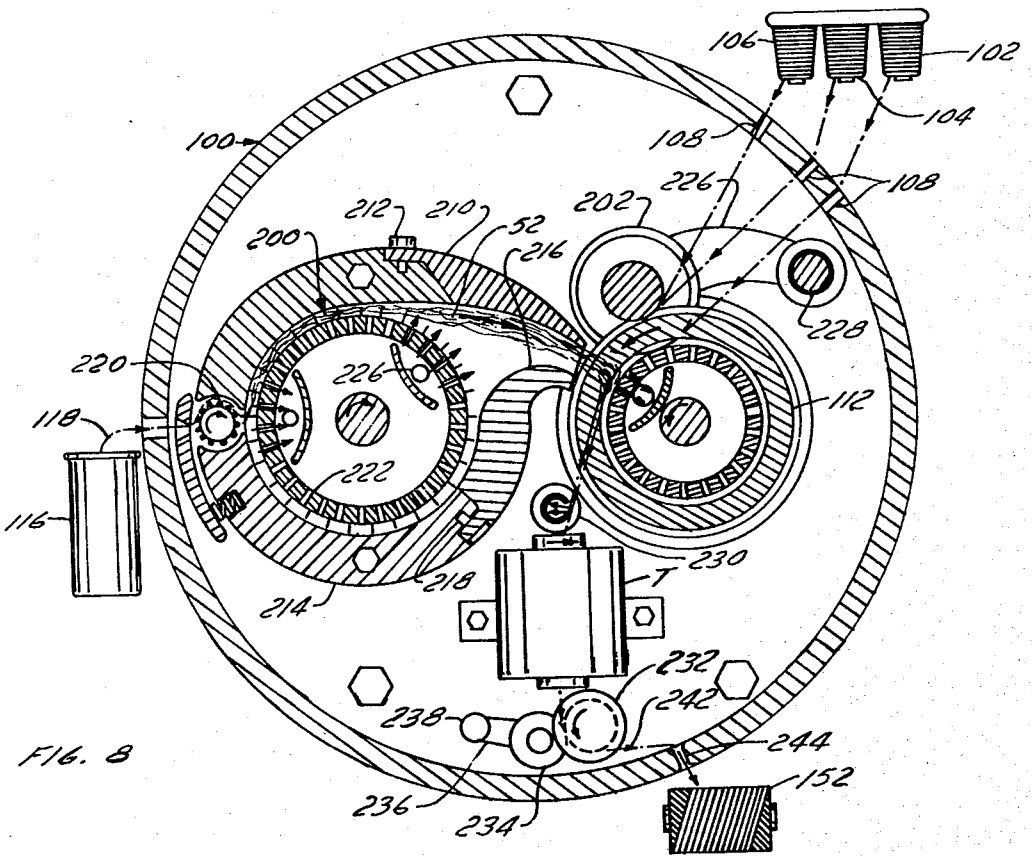
FIG. 8 illustrates a further apparatus according to the present invention illustrating an alternative version for producing the yarns and carrying out the process.

Referring to FIG. 8, a single end version is illustrated showing an alternative arrangement to that of FIG. 1, but operating on the same general principles. In this figure, similar reference numerals have been used to designate similar components relative to the description relating to FIG. 4.

In this embodiment sliver material 118 is fed into a lickerin device indicated generally by reference numeral 200, where it is formed into a source of short fibers 52 which are projected into juxtaposition with the three filaments after they have been passed between a pinch point defined by roller 202 operating in a groove of the drum 112, the groove being similar to groove 144 as shown in FIG. 4.

The lickerin device illustrated in FIG. 8 includes an adjustable housing with a front adjustable portion 210 secured by means of an adjustment screw 212 to the main body 214 of the lickerin housing; likewise, the mouth or discharge outlet of the lickerin may also be adjusted by a lower cover portion 216 secured by means of an adjustable bolt 218 to the housing 214. In this way, the mouth or discharge outlet for the short fibers may be controlled within desired parameters.

As illustrated in FIG. 8, the sliver 118 is fed by means of a rotating tooth or gear type wheel 220 onto the rotating lickerin drum 222 which is provided with a plurality of teeth to comb and doff the short fibers from the sliver. If desired, a source of pressurized air from conduit 226 may be employed for projecting pressurized air through the apertured lickerin roll 222 to aid in the doffing and projection of the short fibers 52 into juxtaposition with the filaments.

The pinch point established by rotating roller 202 may also be adjusted by mounting roller 202 on a pivoting arm 226 which in turn, is mounted on a pivot point 228.

Following the engagement of the short fibers with the filaments and its removal from the groove 144 of the rotating drum 112, a vacuum conduit 230 may be employed for removing any short fibers not otherwise engaged and placed in juxtaposition with the filaments, the vacuum conduit 230 being connected to an appropriate source of vacuum,. Thereafter, the composite filaments and short fibers are passed through a twister indicated by reference letter T, and discharged from the twister between a pair of rollers 232 and 234, the former of which is driven and the latter of which may be adjustably mounted as indicated by arm 236 connected to a pivot point 238. The rollers 232 and 234 form a second pinch point to carry out the process in the manner indicated above with respect to FIG. 1. Thereafter, the resulting plied-type yarn 242 may be subjected to a heat treatment as described above or alternatively, may be exited through aperture 244 in the housing 100 and subsequently wound up on a winder device to form a roll of plied-type yarn 152.

Referring now to FIG. 9, again similar reference numerals have been used to designate similar components to that described with respect to the apparatus of FIG. 4. In this embodiment, however, the covering for the lickerin housing is of a fixed nature so that the cover and housing, indicated by reference numeral 214', directly feed in a fixed relationship the short fibers 52 into juxtaposition with the rotating drum 112 as described hereinafter. The lickerin feed-in device, indicated by reference numeral 220, has a slightly different configuration including a spring-loaded arm 223 to permit adjustment for sliver feed-in. In FIG. 9, as shown in greater detail, and similar to the arrangements shown in FIGS. 4 and 8, the lickerin drum may also include a source of vacuum (not shown) and a vacuum conduit 280 to aid in the combing and doffing operation at the point where the sliver meets the lickerin teeth.

Figure 9:
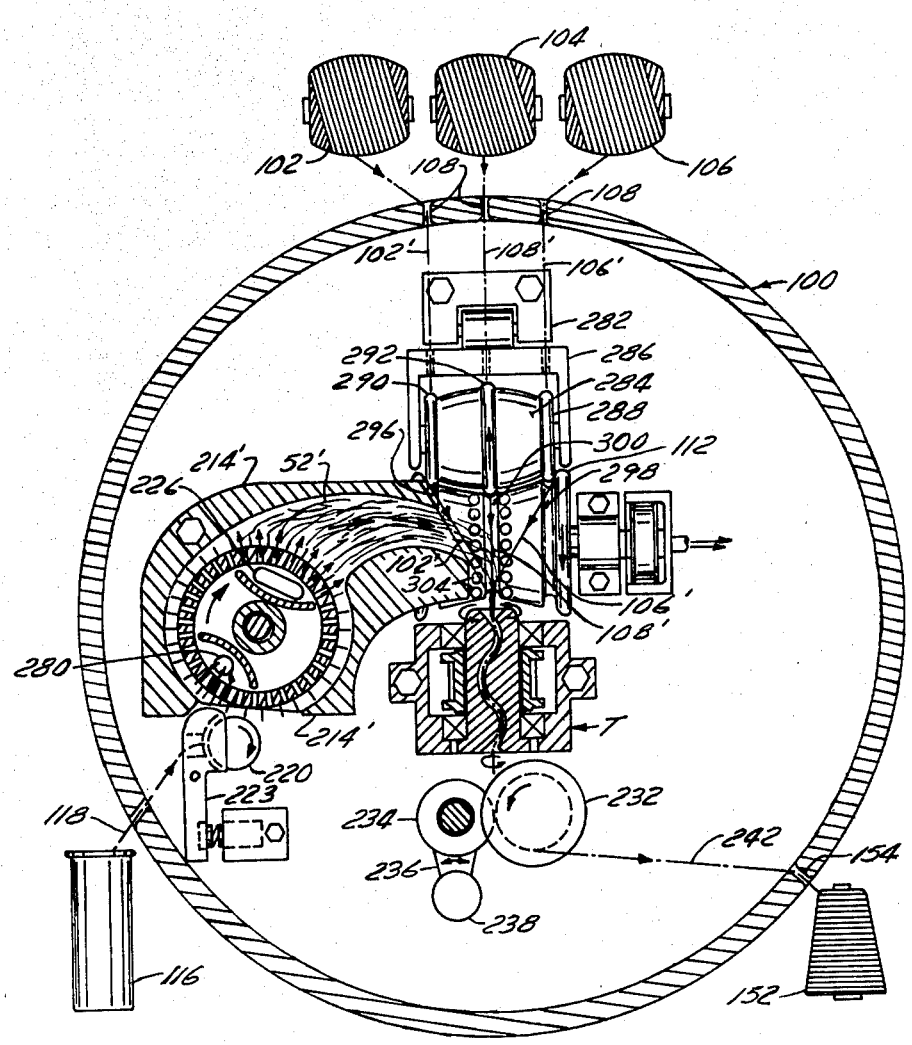
FIG. 9 is a further view similar to FIG. 4 but showing a still further apparatus of the present invention.

In the arrangements illustrated in FIG. 9, the filaments 102', 106' and 108' from their respective sources, are fed in a fixed guide path established by means of a guide 282 and placed into juxtaposition with a rotating roller 284 journalled on a frame 286, which roller is provided with outwardly extending ribs on its surface indicated by reference numerals 288, 290 and 292. Each of these ribs engages a corresponding recess in the drum 112 as will be seen from FIG. 9, the recesses being indicated by reference numerals 296, 298 and 300. The central groove 300, cooperating with the rib 292, has adjacent it, a plurality of apertures 304 which are connected to a vacuum source to aid in the deposition of the short fibers into the groove 300. As also will be noted from FIG. 9, the individual filaments 102', 106' and 108' are placed in juxtaposition with each other in the groove 300; the filaments 106' and 102' converging into the groove 300. Thereafter, the resulting composite filaments are short fibers are passed through a twister T, and exited to pass between rollers 232 and 234 in the manner described previously.

It will be understood that various modifications can be made to the above-described embodiments, without departing from the spirit and scope of the invention herein.

The embodiments of the invention in which an exclusive property or privilege is claimed are defined as follows:

1. A process for forming a yarn comprising the steps of:

supplying at least first and second continuous filaments, the said first filament being of a partially oriented thermoplastic material;

passing at least said first continuous filament between first and second pinch-points;

subsequently subjecting said filaments and fibers to a twisting force while between said pinch-points, such that said first filament is subjected to an intermolecular slippage and said fibers are entrapped between the filaments to form the yarn without the need of an adhesive action to cause adherance of the fibers to the filaments.

2. The process of claim 1 wherein the step of supplying said continuous filaments comprises supplying a plurality of filament packages and withdrawing the filaments therefrom under tension.

3. The process of claim 2 wherein there are provided at least three continuous filaments, all of said filaments being partially oriented.

4. The process of claim 3 wherein each partially oriented filament is passed between said first and second pinch-points.

5. The process of claim 1 wherein the step of placing the fibers into juxtaposition with the filaments comprises feeding the fibers at an angle of between 0° and 90° through said filaments.

6. The process of claim 5 further including the step of passing said filaments and fibers, following said twisting step, through a curved slot.

7. A process for forming a yarn without the necessity of incorporating a pre-twist and comprising the steps of:

supplying at least first and second continuous filaments, the said first filament being of a partially oriented thermoplastic material;

passing at least said first continuous filament between first and second pinch-points;

placing fibers having first and second ends into juxtaposition with said filaments while between said first and second pinch-points; and subsequently subjecting said filaments and fibers to a twisting force while between said pinch-points, such that said first filament is subjected to an intermolecular slippage which prevents a build-up of counter-torque and with the first and second ends of said fibers being entrapped between the filaments to form the yarn and aid in the retention of a positive twist in the yarn, said fibers thereby being adhered to the filaments without the need of an adhesive action to cause adherence of the fibers to the filaments.

* * * * *